US008269156B2

(12) United States Patent
Bergmann et al.

(10) Patent No.: US 8,269,156 B2
(45) Date of Patent: Sep. 18, 2012

(54) GUIDANCE CONTROL SYSTEM FOR PROJECTILES

(75) Inventors: Edward Bergmann, Hopkinton, MA (US); Brian London, Cambridge, MA (US); Andrew Dineen, Melrose, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 939 days.

(21) Appl. No.: 12/042,087

(22) Filed: Mar. 4, 2008

(65) Prior Publication Data

US 2012/0187235 A1 Jul. 26, 2012

(51) Int. Cl.
*F42B 15/01* (2006.01)

(52) U.S. Cl. ..... 244/3.22; 244/3.24; 244/3.27; 244/99.5; 102/372; 102/293

(58) Field of Classification Search ..... 244/3.1, 244/3.21, 3.22, 3.24, 3.26, 3.27, 3.28, 3.29, 244/171.7, 99.5, 99.6, 99.7, 121, 171.8; 102/207, 102/223, 224, 372, 530, 531, 293
See application file for complete search history.

(56) References Cited

U.S. PATENT DOCUMENTS

| | | | | |
|---|---|---|---|---|
| 2,427,972 | A | | 9/1947 | Melchoir |
| 2,943,828 | A | | 7/1960 | Van Driest |
| 3,067,594 | A | | 12/1962 | Bland et al. |
| 3,267,857 | A | | 8/1966 | Lindberg |
| 3,430,536 | A | * | 3/1969 | Oelrich ..... 91/47 |
| 3,471,106 | A | | 10/1969 | Maes |
| 3,532,297 | A | | 10/1970 | Maes |
| 3,785,591 | A | * | 1/1974 | Stalmach, Jr. ..... 244/171.8 |
| 3,863,571 | A | * | 2/1975 | Campagnuolo et al. ..... 102/207 |
| 3,883,096 | A | * | 5/1975 | Osofsky ..... 244/117 A |
| 4,052,024 | A | | 10/1977 | Smith |
| 4,211,378 | A | | 7/1980 | Crepin |
| 4,267,968 | A | | 5/1981 | Scott |
| 4,300,439 | A | | 11/1981 | Degnan et al. |
| 4,531,693 | A | | 7/1985 | Raynaud et al. |
| 4,608,912 | A | | 9/1986 | Navarette |
| 4,681,283 | A | | 7/1987 | Kranz |
| 4,684,080 | A | * | 8/1987 | Pinson ..... 244/3.22 |
| 4,991,797 | A | | 2/1991 | Miller et al. |
| 5,025,627 | A | | 6/1991 | Schneider |
| 5,062,593 | A | | 11/1991 | Goddard et al. |
| 5,074,492 | A | | 12/1991 | Morgand et al. |
| 5,123,611 | A | | 6/1992 | Morgand et al. |
| 5,135,184 | A | | 8/1992 | Billig |
| 5,330,124 | A | * | 7/1994 | Le Touche ..... 244/117 A |
| 5,755,401 | A | * | 5/1998 | Frey et al. ..... 244/3.22 |
| 6,300,378 | B1 | * | 10/2001 | Tapscott ..... 514/743 |
| 6,412,275 | B1 | | 7/2002 | Perrucci |
| 6,435,454 | B1 | | 8/2002 | Engelhardt |

(Continued)

OTHER PUBLICATIONS

Parsch, Andreas, "Sidewinder, A Historical Essay" [online]. Encyclopedia Astro [retrieved Oct. 29, 2007]. Retrieved from the Internet: <http://wvvw.astronautix.com/lvs/sidinder.htm>, 14 pages.

*Primary Examiner* — Joseph W Sanderson
(74) *Attorney, Agent, or Firm* — Goodwin Procter LLP

(57) ABSTRACT

A projectile is guided by employing heat, generated from the aerodynamic heating of a surface of the projectile while the projectile is in flight, to vaporize a material stored within the projectile. The resulting gas is used to guide the projectile.

26 Claims, 4 Drawing Sheets

U.S. PATENT DOCUMENTS

| | | | | |
|---|---|---|---|---|
| 6,446,909 | B1 | 9/2002 | Michelson | |
| 6,935,355 | B2 | 8/2005 | Eldridge | |
| 7,070,144 | B1 * | 7/2006 | DiCocco et al. | 244/3.21 |
| 7,102,113 | B2 * | 9/2006 | Fujita et al. | 244/3.1 |
| 7,185,851 | B2 | 3/2007 | Elam | |
| 7,216,474 | B2 | 5/2007 | Bulman et al. | |
| 7,281,688 | B1 * | 10/2007 | Cox et al. | 244/159.1 |
| 2007/0252045 | A1 * | 11/2007 | Cox et al. | 244/171.7 |

* cited by examiner

GUIDANCE CONTROL SYSTEM FOR PROJECTILES

TECHNICAL FIELD

In various embodiments, the present invention relates to a guidance-control system for projectiles.

BACKGROUND

Typically, to steer guided projectiles, such as missiles or other airborne munitions, aerosurfaces or reaction-control systems (e.g., systems that employ nozzles or valves to release a fluid or gas) are actuated. For example, guided munitions may be steered by using electric actuators, powered by onboard batteries, to drive the aerosurfaces through mechanical linkages. These actuators, batteries, and linkages contribute substantially to a round's launch weight and occupy valuable (and scarce) onboard volume that could otherwise be used for additional payload or eliminated to extend the range of the projectile. Mechanical linkages also have a relatively high risk of failure under launch loads, as the munitions experience extreme launch accelerations and velocities. In addition, battery storage life may limit the amount of time that such systems may be stored, i.e., the systems may require periodic maintenance to recharge or replace the batteries. This may also affect operational readiness by minimizing up-time and increasing the logistics burden.

For their part, reaction-control systems typically employ either compressed gas stored onboard in pressure vessels prior to launch (known as "cold-gas systems"), or solid gas generators that generate the compressed gas subsequent to launch (for example through a combustible fuel that is ignited). Traditional cold-gas systems are massive and limited in available impulse. They generally require large and heavy storage tanks, which limit their use in guided projectiles. Solid gas generators are also large, generate heat internal to the round that may adversely impact other components, are impulse-limited, have additional ignition requirements, and create a high risk of jamming components of the reaction-control system with accumulated combustion products and residues.

In conventional projectiles, pneumatic actuators are large and heavy, and may not survive extreme operational environments. Hydraulic actuators generally require surge suppression. They too are large and heavy, and may have slow response times. Piezoelectric actuators tend to have limited force and displacement, require high voltages, and experience problems due to induced currents and hysteresis. Similarly, electromagnetic actuators may have insufficient structural strength, and also experience hysteresis. Shape memory alloy actuators typically have insufficient displacement, are affected by temperature fluctuations, and experience hysteresis.

SUMMARY OF THE INVENTION

In various embodiments, the present invention employs heat, generated from the aerodynamic heating of a projectile's surface while the projectile is in flight, to either sublime or boil a solid or liquid material stored within the projectile. A gas is thereby generated and may be used to pneumatically actuate aerodynamic surfaces, or provide reaction-control, to guide the projectile (by, for example, controlling the projectile's attitude) to its intended target. Advantageously, because the solid or liquid material absorbs heat, it protects internal heat-sensitive components, such as electronics, which would otherwise require internal insulation.

In various embodiments, the present invention may provide for a higher level of total impulse in a smaller volume than a cold-gas system, avoids linkages associated with electric actuation, decreases the mass penalties associated with batteries, and should require less volume than either cold-gas or hydraulic systems of similar power or total energy. Moreover, projectiles in accordance with the present invention may be designed to be inert in storage, thereby mitigating hazards associated with pyrotechnic gas generators. In addition, because embodiments of the present invention passively use aerodynamic heating, there is no need for initiation commands, unlike in gas generators and thermal batteries.

In general, in one aspect, a method for guiding a projectile employs heat, generated from the aerodynamic heating of a surface of the projectile while the projectile is in flight, to vaporize a material stored within the projectile. A gas generated by the vaporization of the material is then utilized to guide the projectile.

In general, in another aspect, a projectile includes a material vaporizable by heat generated from the aerodynamic heating of a surface of the projectile while the projectile is in flight, and means for utilizing a gas generated by the vaporization of the material to guide the projectile.

In general, in yet another aspect, a guidance-control system includes a material vaporizable by heat generated from the aerodynamic heating of a surface while the guidance-control system is in flight and means for utilizing a gas generated by the vaporization of the material to guide a projectile.

In general, in still another aspect, a method for guiding a projectile employs heat, generated from the aerodynamic heating of a surface of the projectile while the projectile is in flight, to precipitate a phase change for a material stored within the projectile. The method also maintains, for a period of time, the material in the vicinity of its triple point. A pressure exerted on the material is then reduced to generate a gas, and the gas is utilized to guide the projectile.

In various embodiments, the material stored within the projectile is a wax, such as, for example, a perfluorinated hydrocarbon. The material stored within the projectile may, alternatively, be a solid that is vaporized by sublimation, a liquid that is vaporized by boiling, or a solid that is vaporized by first being melted to a liquid and then boiled. The material may also be non-corrosive and non-explosive, and may absorb heat to protect heat sensitive components internal to the projectile. In one embodiment, the projectile includes a resistive element in proximity to the material and the projectile is exposed to an electromagnetic field in order to accelerate the vaporization of the material.

The gas generated from the material may be used to pneumatically actuate aerodynamic surfaces to guide the projectile, or may be expelled from the projectile (for example through a nozzle or valve) to guide the projectile. The projectile may include, for example, a military warhead. In various embodiments, the projectile is a missile, a rocket, a gun-launched projectile, a re-entry vehicle, or an aircraft.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

In broad overview, the present invention, in various embodiments, relates to a heat activated guidance-control system for projectiles. In one embodiment, the guidance-control system employs heat generated from the aerodynamic heating of a surface of the projectile while the projectile is in flight.

Figure 1:
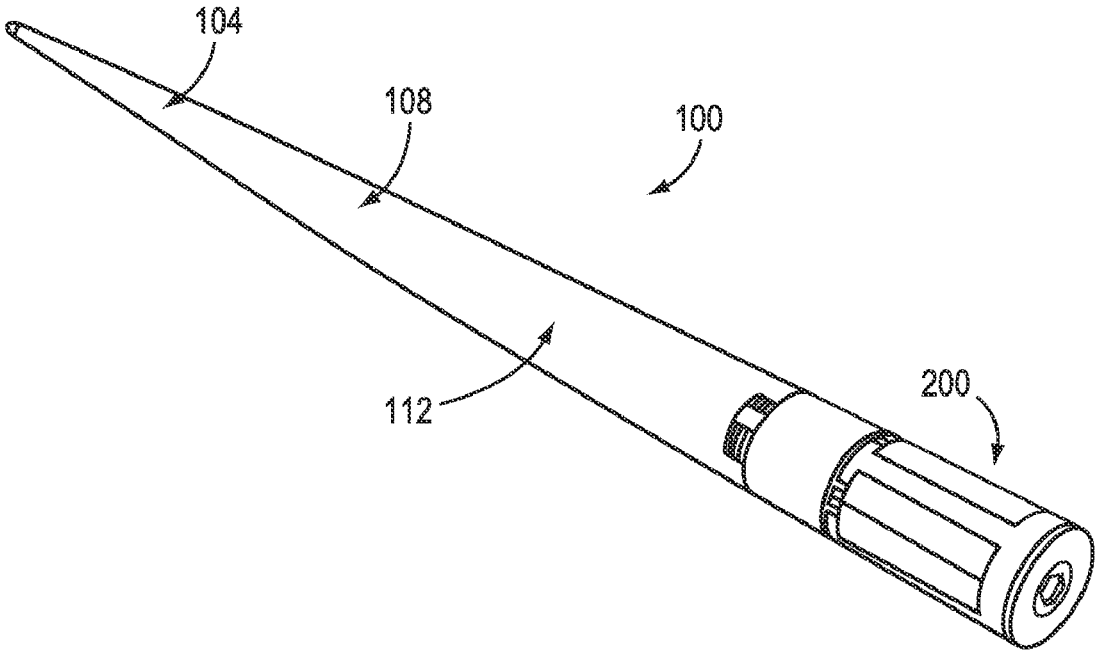
FIG. 1 is a perspective view of an exemplary projectile in accordance with one embodiment of the invention.

FIG. 1 depicts an exemplary projectile 100 in accordance with one embodiment of the invention. The illustrated projectile 100 includes a nose tip section 104, a payload 108 (such as a military warhead), electronic circuitry 112, and a guidance-control system 200. While the guidance-control system 200 is depicted in FIG. 1 as being a part of a missile, those of ordinary skill in the art will understand that the system 200 described herein, and the methods it employs, may be used to guide high-speed projectiles other than missiles, such as, for example, gun-launched projectiles, rockets, re-entry vehicles, and aircraft.

Figure 2:
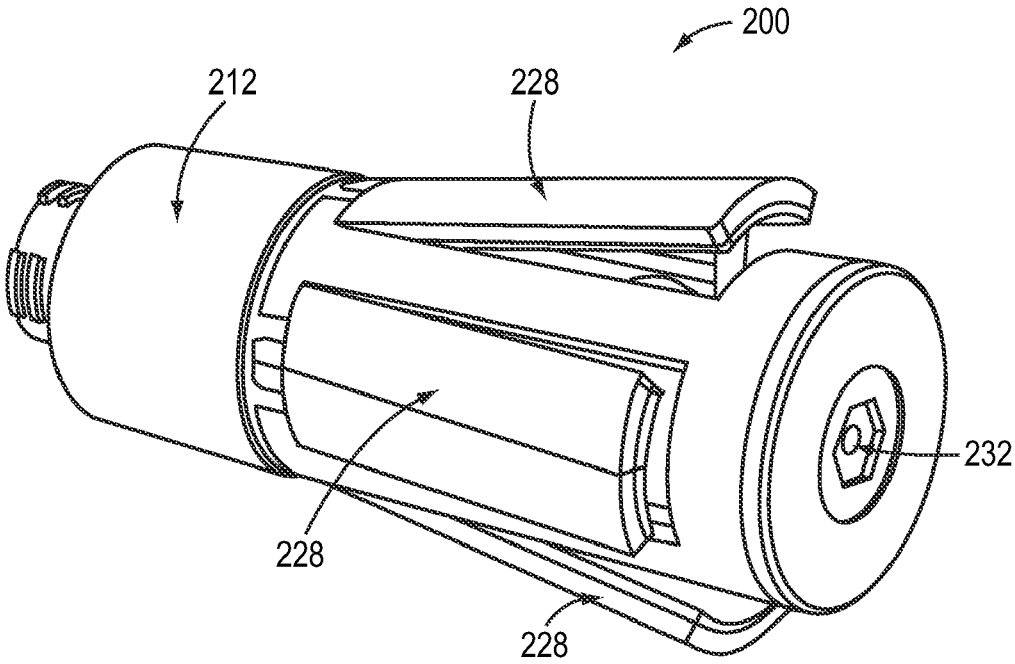
FIG. 2 is an enlarged perspective view of one embodiment of a guidance-control system for the projectile depicted in FIG. 1.
Figure 3:
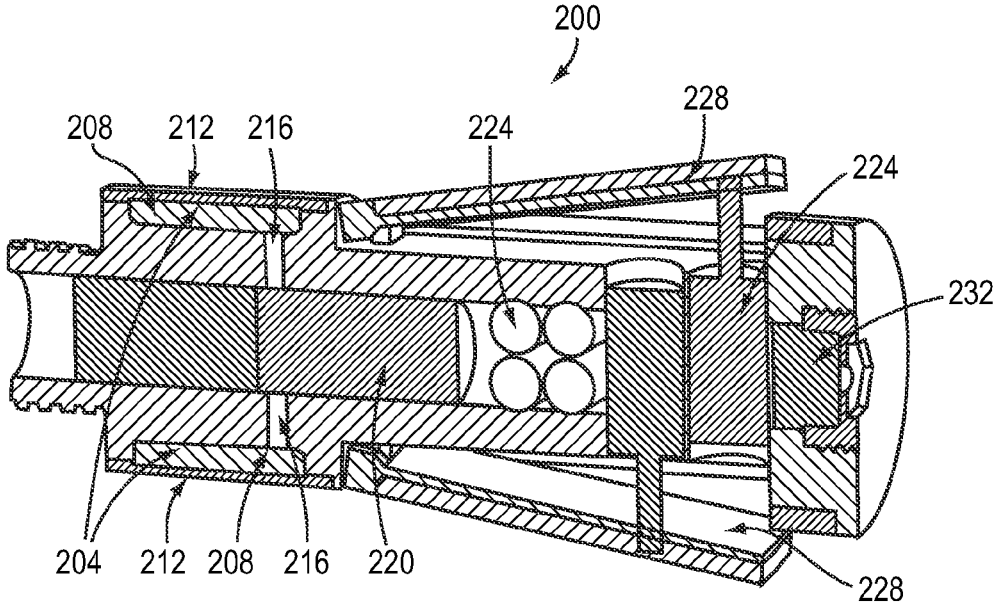
FIG. 3 is a cross-sectional view of the guidance-control system depicted in FIG. 2.
Figure 4:
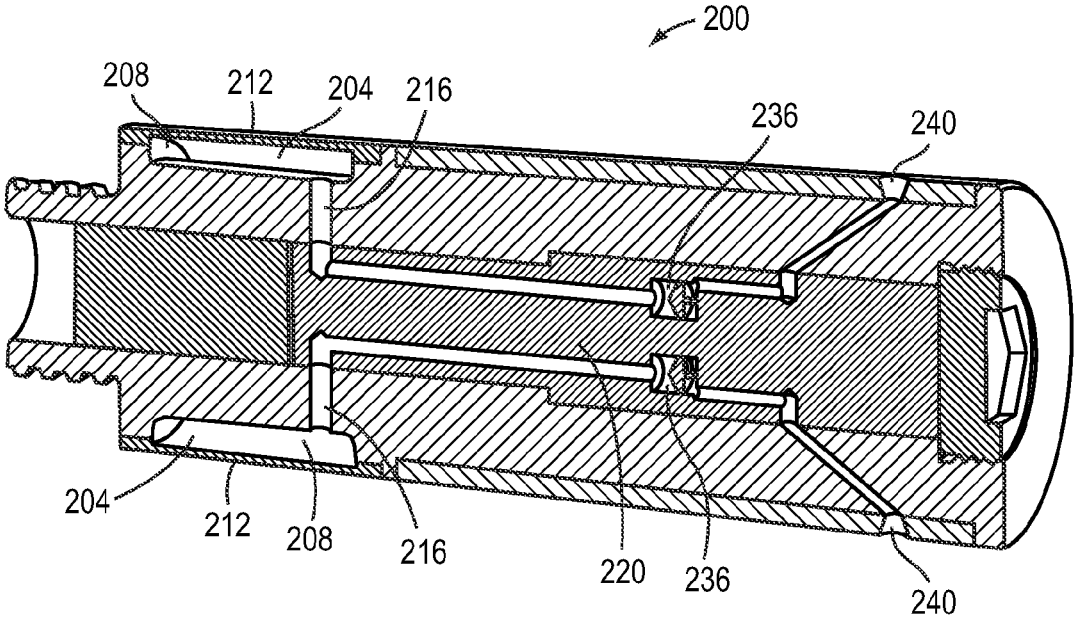
FIG. 4 is a cross-sectional view of another embodiment of a guidance-control system for the projectile of FIG. 1.

FIG. 2 depicts one embodiment of the guidance-control system 200 in greater detail, while FIG. 3 depicts a cross-sectional view of the guidance-control system 200 depicted in FIG. 2. For its part, FIG. 4 depicts a cross-sectional view of an alternative embodiment of the guidance-control system 200. With reference to FIGS. 2, 3, and 4, the guidance-control system 200 may include a chamber 208 located just beneath an exterior surface 212 of the projectile 100. The chamber 208 may be, for example, in the form of a ring, and may initially store a material 204, such as a solid, a liquid, or a wax, therein. As described further below, the material 204 may be, during the flight of the projectile 100, vaporized (i.e., sublimed, boiled, or first melted and then boiled) through heat generated from the aerodynamic heating of the exterior surface 212. Accordingly, the chamber 208 may also be used to store and compress the gas generated by the vaporization of the material 204.

As illustrated in FIGS. 3 and 4, the chamber 208 may be coupled by one or more controllable ports 216 to an entry control-valve assembly 220. The entry control-valve assembly 220 may itself be coupled to one or more components that are used to guide the projectile 100 while in flight. For example, as illustrated in FIG. 3, the entry control-valve assembly 220 may be coupled to one or more pneumatic actuators 224 (e.g., pistons) that are used to actuate one or more aerodynamic surfaces 228 (e.g., flaps, canards, etc.) of the projectile 100. Alternatively, and with reference now to FIG. 4, the entry control-valve assembly 220 may be coupled through one or more of its control valves 236 to one or more nozzles 240. The embodiment of the guidance-control system 200 depicted in FIG. 3 may further include an exit control-valve assembly 232.

Once the material 204 is vaporized and compressed as a gas within the chamber 208, as described in further detail below, that compressed gas may be, through controlled action of the ports 216 and the entry control-valve assembly 220, used to pneumatically actuate the aerodynamic surfaces 228 and thereby guide the projectile 110, or expelled from the projectile through one or more the nozzles 240, such as jet thrusters, in order to guide the projectile 110. For example, the aerodynamic surfaces 228 (e.g., flaps, canards, etc.) may be actuated by the compressed gas and through the pneumatic actuators 224 to control the yaw, roll, pitch, lift, and/or drag of the projectile 100. The aerodynamic surfaces 228 may be de-actuated (i.e., closed) by, for example, opening a valve in the exit control-valve assembly 232, which lowers the internal pressure acting on the pneumatic actuators 224. As another example, expelling the compressed gas through the nozzle 240 of the projectile 100 when the projectile 100 is in flight within the earth's atmosphere causes the compressed gas to interact with the ambient air flow and thereby change the lift characteristics of the projectile 100 (which is commonly referred to as "jet interaction"), while expelling the compressed gas through the nozzle 240 of the projectile 100 when the projectile 100 is in flight outside of the earth's atmosphere (i.e., in space) re-directs and/or rotates the projectile 100 in a direction opposite to the direction in which the compressed gas is expelled. One skilled in the art will understand that the electronic circuitry 112 (see FIG. 1) of the projectile 100 may be configured to open and close valves in the ports 216 and in the entry control-valve assembly 220 (e.g., valves 236), as appropriate, to regulate both the amount of gas released from the chamber 208 and the particular pneumatic actuator(s) 224 or nozzle(s) 240 to which that gas is directed. The electronic circuitry 112 is conventional in the art and may implement any suitable program or algorithm to guide and control the projectile 100.

In one embodiment, the material 204 that is initially stored within the chamber 208 is one which has a vaporization point (i.e., a sublimation or boiling point) below the peak temperature expected to occur within the chamber 208 while the projectile 100 is in flight, but that is high enough to prevent vaporization of the material 204 while the guidance-control system 200 is in storage. For example, in one embodiment where the projectile 100 is a missile, the material 204 has a sublimation or boiling point below 300° C. In another embodiment where the projectile 100 is a missile, the material 204 has a sublimation or boiling point below 250° C. The selected material 204 may also be one that has a high expansion upon subliming or boiling, is non-toxic, non-corrosive, and non-explosive, has a low molecular weight, and has a shelf life of approximately 20 years (i.e., is inert and safe in storage). The material 204 may also be one that sublimes or boils rapidly, so that the gas it generates may be used immediately after the projectile 100 is launched.

Any solid, liquid, or wax having the properties described above may be used as the material 204. Exemplary materials suitable for use include water and perfluorinated hydrocarbons, such as docosafluoro-decane ($C_{10}F_{22}$) and hexacosafluoro-dodecane ($C_{12}F_{26}$). Docosafluoro-decane, for example, has a melting point of 36° C., a boiling point of 133° C., and an enthalpy of vaporization of approximately 37 kJ per mole at 1 bar pressure. In its solid phase, docosafluoro-decane has a density of 1.770 g/cm$^3$. For its part, hexacosafluoro-dodecane has a melting point of 75° C., a boiling point of 178° C., and an enthalpy of vaporization of approximately 41 kJ per mole at 1 bar pressure. In its solid phase, hexacosafluoro-dodecane has a density of 1.670 g/cm$^3$.

In one embodiment, while the projectile 100 is in flight and within the earth's atmosphere (e.g., upon ascent or descent), aerodynamic effects heat the exterior surface 212 of the projectile 100 to very high temperatures. More specifically, high rates of aerodynamic heating occur on the exterior surface 212 as a result of the high velocities reached by the projectile 100 and the consequent air drag acting on the projectile 100. If the projectile 100 were to leave the earth's atmosphere and enter space, however, air drag would disappear and aerodynamic heating on the exterior surface 212 of the projectile would be minimal to non-existent. Of course, upon re-entering the earth's atmosphere air drag will again act on the projectile 100 and the projectile's exterior surface 212 will once again be subject to aerodynamic heating.

Accordingly, while the projectile 100 is in flight and within the earth's atmosphere, heat generated from the aerodynamic heating of the surface 212 of the projectile 100 may be conducted to the chamber 208 storing the material 204 and employed to vaporize the material 204 (e.g., sublime a solid material 204, boil a liquid material 204, or first melt a solid material 204 to a liquid and then boil it). In one embodiment, the chamber 208 is a confined space and its volume is constant. Consequently, the gas resulting from the vaporization of the material 204 is pressurized over time. The pressure reached is a function of the heat flow into the chamber 208, the properties of the material 204, and the ratio of the volume of the chamber 208 to the expansion space therein. The resulting compressed gas may be used to perform useful work, including, as described above, moving the aerosurfaces 228 via the pneumatic actuators 224 and reaction-control by controlled release of the compressed gas through the nozzles 240.

If the projectile 100 were to leave the earth's atmosphere, or in the event that ambient heat input is insufficient to continue vaporization of the material 204, thermal inertia of the projectile 100 components may maintain the working fluid (i.e., the compressed gas) in its vaporized state.

Alternatively, in another embodiment, the pressure inside the chamber 208 that stores the material 204 may be controlled and regulated, as appropriate for a given amount of heat that is generated from the aerodynamic heating of the surface 212 of the projectile 100 and applied to the chamber 208, so that that combination of heat and pressure only induces a phase change of the material 204 and does not fully vaporize the material 204 to a gas. For example, the electronic circuitry 112 of the projectile 100 may be employed to expand or reduce the volume of the chamber 208 to alter the pressure therein, as appropriate for a given amount of heat applied thereto, such that the material 204 begins to change phase but is then maintained in the vicinity of its triple point (i.e., at a given temperature and pressure where all three phases—gas, liquid, and solid—of the material 204 coexist in thermodynamic equilibrium).

The material 204 may then be maintained in the chamber 208 in the vicinity of its triple point for a period of time, for example until useful work, such as guiding the projectile 100 in some manner, is to be performed. Subsequently, once that useful work is to be performed, the electronic circuitry 112 of the projectile 100 may cause one or more valves in the ports 216 and/or entry control-valve assembly 220 to open, thereby reducing the pressure inside the chamber 208 (i.e., the pressure being exerted on the material 204). By reducing the pressure exerted on the material 204, the material 204 rapidly moves from its triple point and expands to a pure gas. The pure gas, in turn, is immediately available to perform useful work, including, as described above, moving the aerosurfaces 228 via the pneumatic actuators 224 and reaction-control by controlled release of the compressed gas through the nozzles 240 of the projectile 100.

In various embodiments, if guidance of the projectile 100 is required before heat sufficient to vaporize the material 204 has been generated aerodynamically, adjunct heating may be provided to accelerate the vaporization of the material 204 or to vaporize a portion of the material 204 until the aerodynamic heating takes over to vaporize the remaining portion of the material 204. The adjunct heating may be, for example, chemical (e.g., pyrotechnic or exothermic chemistry) or electrical. Where, for example, the projectile 100 is launched from an electromagnetic gun (as, for example, a missile or other gun-launched projectile may be), a resistive heating element may be embedded into the material 204. In such a case, the high electric fields of the launch environment may be used to induce a current in the resistive heating element, and thereby generate heat. This heat generated by the resistive heating element may be used to accelerate the vaporization of the material 204 and/or may vaporize sufficient material 204 to provide a working gas until aerodynamic heating takes over to vaporize what remains of the material 204.

The guidance-control system 200 described herein provides many advantages. For example, unlike traditional guidance-control systems that require a great deal of power to drive electronic actuators, the guidance-control system 200 has low power requirements, as the work involved in guiding the projectile 100 is performed by material expansion. Only minimal power is required to control the valves of the ports 216, entry control-valve assembly 220, and exit control-valve assembly 232.

The guidance-control system 200 described herein is also inherently more efficient than a traditional cold-gas system, as the system 200 described herein provides more total work for a given volume. In addition, the material 204 may be stored around heat sensitive components internal to the projectile 100, such as electronics, to draw and absorb heat from those components, thereby protecting those components. For example, the volume expansion of the material 204 as pressure is lowered may absorb thermal energy from the surrounding environment. This reduces the thermal insulation or shielding requirements of traditional guidance-control systems, thereby also freeing up volume for additional payload and/or reducing the weight of the projectile 100. The material 204 may also be chosen so as to protect shock sensitive components internal to the projectile 100 from extreme launch and acceleration environments by, for example, acting as an encapsulant during the initial launch acceleration.

The guidance-control system 200 described herein is also less complex than systems employing batteries or pyrotechnic gas generators, which require initiation. In addition, the guidance-control system 200 is also safer than pyrotechnic systems, as it poses no explosion hazard from inadvertent initiation. Also, unlike some solid gas generators, the guidance-control system 200 does not generate slag or produce exhaust products that may clog or interfere with actuators. Moreover, as mentioned, the material 204 may be non-toxic, thereby eliminating environmental hazards from its use.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method for guiding a projectile, comprising:

employing heat, generated from the aerodynamic heating of an exterior surface of the projectile while the projectile is in flight, to vaporize a material stored within an inner chamber of the projectile that is adjacent to the exterior surface of the projectile, the exterior surface of the projectile sealing the inner chamber from the external environment surrounding the projectile; and utilizing a gas generated by the vaporization of the material to guide the projectile.

2. The method of claim 1, wherein the material stored within the projectile is selected from the group consisting of a solid, a liquid, and a wax.

3. The method of claim 1, wherein the material stored within the projectile is a solid that is vaporized by sublimation.

4. The method of claim 1, wherein the material stored within the projectile is a liquid that is vaporized by boiling.

5. The method of claim 1, wherein the material stored within the projectile is a perfluorinated hydrocarbon in its solid phase.

6. The method of claim 1, wherein the material stored within the projectile is non-corrosive and non-explosive.

7. The method of claim 1, wherein the gas is used to pneumatically actuate aerodynamic surfaces to guide the projectile.

8. The method of claim 1, wherein the gas is expelled from the projectile to guide the projectile.

9. The method of claim 1, wherein the projectile comprises a military warhead.

10. The method of claim 1, wherein the projectile is selected from the group consisting of a missile, a rocket, a gun-launched projectile, a re-entry vehicle, and an aircraft.

11. The method of claim 1 further comprising exposing the projectile to an electromagnetic field to accelerate the vaporization of the material.

12. A projectile, comprising:

a material stored within an inner chamber of the projectile that is adjacent to an exterior surface of the projectile, the material being vaporizable by heat generated from the aerodynamic heating of the exterior surface of the projectile while the projectile is in flight, the exterior surface of the projectile sealing the inner chamber from the external environment surrounding the projectile; and means for utilizing a gas generated by the vaporization of the material to guide the projectile.

13. The projectile of claim 12, wherein the material is selected from the group consisting of a solid, a liquid, and a wax.

14. The projectile of claim 12, wherein the material is a solid and the inner chamber stores and compresses the gas, the gas generated by subliming the solid.

15. The projectile of claim 12, wherein the material is a liquid and the inner chamber stores and compresses the gas, the gas generated by boiling the liquid.

16. The projectile of claim 12, wherein the material is a perfluorinated hydrocarbon in its solid phase.

17. The projectile of claim 12, wherein the material is non-corrosive and non-explosive.

18. The projectile of claim 12, wherein the means for utilizing the gas to guide the projectile comprises a pneumatic actuator for actuating an aerodynamic surface of the projectile.

19. The projectile of claim 12, wherein the means for utilizing the gas to guide the projectile comprises a nozzle for expelling the gas from the projectile.

20. The projectile of claim 12, wherein the material absorbs heat to protect heat sensitive components internal to the projectile.

21. The projectile of claim 12 further comprising a military warhead.

22. The projectile of claim 12, wherein the projectile is selected from the group consisting of a missile, a rocket, a gun-launched projectile, a re-entry vehicle, and an aircraft.

23. The projectile of claim 12 further comprising, in proximity to the material, a resistive element for accelerating the vaporization of the material.

24. The projectile of claim 12, wherein the material is selected to protect shock sensitive components internal to the projectile from launch and acceleration environments.

25. A guidance-control system, comprising:

a material stored within an inner chamber of the guidance-control system that is adjacent to an exterior surface of the guidance-control system, the material being vaporizable by heat generated from the aerodynamic heating of the exterior surface of the guidance-control system while the guidance-control system is in flight, the exterior surface of the guidance-control system sealing the inner chamber from the external environment surrounding the guidance-control system; and means for utilizing a gas generated by the vaporization of the material to guide a projectile.

26. A method for guiding a projectile, comprising:

employing heat, generated from the aerodynamic heating of an exterior surface of the projectile while the projectile is in flight, to precipitate a phase change for a material stored within an inner chamber of the projectile that is adjacent to the exterior surface of the projectile, the exterior surface of the projectile sealing the inner chamber from the external environment surrounding the projectile;

maintaining, for a period of time, the material at a temperature and pressure where gas, liquid, and solid phases of the material coexist in thermodynamic equilibrium;

thereafter, reducing a pressure exerted on the material to generate a gas; and utilizing the gas to guide the projectile.

* * * * *